US008661795B2

(12) United States Patent
Eavenson, Sr.

(10) Patent No.: US 8,661,795 B2
(45) Date of Patent: Mar. 4, 2014

(54) EXHAUST SYSTEM HAVING MULTIPLE INLETS AND MULTIPLE OUTLETS

(75) Inventor: Jimmy N. Eavenson, Sr., Aurora, OH (US)

(73) Assignee: MTD Products Inc, Valley City, OH (US)

( * ) Notice: Subject to any disclaimer, the term of this patent is extended or adjusted under 35 U.S.C. 154(b) by 333 days.

(21) Appl. No.: 13/041,502

(22) Filed: Mar. 7, 2011

(65) Prior Publication Data

US 2011/0219749 A1 Sep. 15, 2011

Related U.S. Application Data

(60) Provisional application No. 61/311,965, filed on Mar. 9, 2010.

(51) Int. Cl.

| | |
|---|---|
| ***F01N 3/10*** | (2006.01) |
| ***F02K 1/00*** | (2006.01) |
| ***F02K 1/82*** | (2006.01) |
| ***F01N 13/08*** | (2010.01) |
| ***F01N 1/02*** | (2006.01) |
| ***F01N 1/08*** | (2006.01) |

(52) U.S. Cl.
USPC ..... 60/299; 181/213; 181/228; 181/251; 181/272

(58) Field of Classification Search
USPC ..... 60/299, 324; 181/213, 227, 228, 251, 181/272
See application file for complete search history.

(56) References Cited

U.S. PATENT DOCUMENTS

| | | | | |
|---|---|---|---|---|
| 3,841,841 | A | 10/1974 | Torosian et al. | |
| 4,076,099 | A | 2/1978 | Proksch | |
| 4,154,058 | A | 5/1979 | Mase et al. | |
| 4,188,783 | A | 2/1980 | Sayo et al. | |
| 4,354,349 | A * | 10/1982 | Otani et al. | 60/299 |
| 4,433,542 | A | 2/1984 | Shimura | |
| 4,487,289 | A | 12/1984 | Kicinski et al. | |
| 5,123,502 | A | 6/1992 | Flugger | |
| 5,293,744 | A | 3/1994 | Imagawa et al. | |
| 5,338,903 | A | 8/1994 | Winberg | |
| 5,392,602 | A | 2/1995 | Matsumoto | |
| 5,844,177 | A | 12/1998 | Pirchl | |
| 6,702,062 | B2 | 3/2004 | Kusabiraki et al. | |
| 6,796,402 | B1 * | 9/2004 | Wagner | 181/238 |
| 7,152,398 | B2 | 12/2006 | Bassani | |
| 7,320,299 | B2 | 1/2008 | Eavenson, Sr. et al. | |
| 7,334,402 | B2 | 2/2008 | Hiraga | |
| 2007/0151798 | A1 | 7/2007 | Smith | |

(Continued)

FOREIGN PATENT DOCUMENTS

| | | | | |
|---|---|---|---|---|
| JP | 06108835 | A * | 4/1994 | F01N 3/24 |
| JP | 2006327586 | A | 12/2006 | |

*Primary Examiner* — Kenneth Bomberg
*Assistant Examiner* — Audrey K Bradley
(74) *Attorney, Agent, or Firm* — Wegman, Hessler & Vanderburg

(57) ABSTRACT

An exhaust system for exhausting multiple cylinders of a small engine, wherein the exhaust system includes a plurality of exhaust units is described herein. Each exhaust unit of the exhaust system is operatively and fluidly connected to a separate cylinder of the small engine such that the exhaust gases from each cylinder remain separated as they pass through different exhaust units of the exhaust system. The exhaust system includes at least two exhaust units, and of the exhaust units is separated by an inner chamber wall that is shared by adjacent exhaust units yet prevents fluid communication between the adjacent exhaust units.

8 Claims, 3 Drawing Sheets

(56) References Cited

U.S. PATENT DOCUMENTS

| | | | | |
|---|---|---|---|---|
| 2007/0289294 | A1 | 12/2007 | Werni et al. | |
| 2008/0110155 | A1 | 5/2008 | Harada | |
| 2009/0000282 | A1 | 1/2009 | Gruber | |
| 2009/0000862 | A1 | 1/2009 | Buell et al. | |
| 2009/0188246 | A1* | 7/2009 | Galligan | 60/299 |
| 2009/0301808 | A1 | 12/2009 | Mabuchi | |
| 2010/0006370 | A1 | 1/2010 | Shaya | |
| 2010/0192880 | A1* | 8/2010 | Koyanagi et al. | 123/54.4 |

* cited by examiner

EXHAUST SYSTEM HAVING MULTIPLE INLETS AND MULTIPLE OUTLETS

CROSS-REFERENCE TO RELATED APPLICATIONS

The present application claims priority under 35 U.S.C. 119(e) to U.S. Provisional Patent Application No. 61/311,965, filed Mar. 9, 2010.

FIELD OF THE INVENTION

This invention relates generally to exhaust systems. More particularly, the invention relates to an exhaust system for a multi-cylinder internal combustion engine.

BACKGROUND

Traction drive machines having small internal combustion engines, such as powered machines used for lawn care, commonly employ exhaust systems to convey the exhaust gas from the engine cylinders to the ambient environment. Small internal combustion engines are typically defined as engines having 25 horsepower or less.

Small engines have higher concentrations of exhaust gas constituents requiring conversion. This is a result of the richer air:fuel ratios required in small engines for successful operation and engine cooling. The compact size of the exhaust catalyst, the high specific throughput (about 10 times higher than automotive), and the high concentration of emission constituents result in high heat generation rates and high catalyst temperatures.

These exhaust systems typically do not include means to control the effects of "off nominal" conditions of engines. Off nominal conditions can be described as when one or more cylinders are not functioning properly (or optimally) such that the air:fuel exhaust gas mixtures entering the exhaust system are combustible mixtures and create excessively high exhaust gas and system temperatures if ignited. Sources of off nominal conditions include ignition misfiring, air:fuel cylinder-to-cylinder imbalance, and mechanical malfunction of an intake or exhaust valve. Sources of ignition include hot exhaust catalysts and exhaust gasses from a nominal cylinder.

Therefore, off nominal conditions are very dangerous when the exhaust gasses from multiple cylinders are allowed to mix because the high exhaust gas and system temperatures from a nominal cylinder could ignite an unburned fuel mixture from an off nominal cylinder and cause unintended combustion and flames. For example, a V-twin air-cooled two cylinder engine with a dual-inlet single-outlet exhaust with catalysts normally has an exhaust gas temperature of 1350° F. However, if one sparkplug is caused to miss-fire, an unignited fuel:air exhaust gas mixture enters an exhaust chamber, mixes with ignited exhaust gasses from nominal cylinders, and ignites, which causes the exhaust gases to increase 1020° F. in 10 seconds to 2370° F. Further, off nominal conditions increase the risk of a meltdown of the catalyst substrate, which can result in catalytic deactivation and severe exhaust restriction.

The exhaust temperatures which occurred during off nominal conditions in the scenario described above would be even higher if small engine designers attempted to achieve catalyst efficiencies approaching those of automotive catalysts. The high exhaust gas concentrations and high space velocities produced by a higher efficiency catalyst could create even higher heat loads and temperatures. Thus, in the scenario described above, it is necessary to limit the initial catalyst efficiency to protect the engine and exhaust system.

It is known that some engine fuel management systems include oxygen sensors or temperature sensors that intend to limit the effects of off nominal conditions found during operation of engines, but these are typically expensive and create a machine control issue by reducing the overall engine power as quickly as possible when an off nominal condition is detected.

Accordingly, a need exists for an inexpensive exhaust system that reduces the dangers of off nominal conditions.

SUMMARY OF INVENTIVE FEATURES

In one aspect of the present invention, an exhaust system for exhausting exhaust gases from a small engine having multiple cylinders is provided. The exhaust system includes at least two exhaust units. Each of said exhaust units includes a primary chamber, an inlet, an outlet, a primary stage transfer tube, and a catalyst. The inlet is fluidly connected to the primary chamber for introducing exhaust gases into the primary chamber. The outlet is fluidly connected to the primary chamber for exhausting exhaust gases from the primary chamber. At least a portion of the primary stage transfer tube is located within the primary chamber, and the primary stage transfer tube fluidly connects the primary chamber with the outlet. The catalyst is located within the primary chamber between the inlet and the outlet. Exhaust gases pass through the catalyst as the exhaust gases flow from the inlet to the outlet. Each of the at least two exhaust units is separated from at least one other of the at least two exhaust units by a common chamber wall, wherein the chamber wall maintains separation between exhaust gases flowing through each of the at least two exhaust units.

In another aspect of the exhaust system of the present invention described above, at least two of the at least two exhaust units are disposed immediately adjacent to each other.

In another aspect of the exhaust system of the present invention described above, the catalyst is disposed about a portion of the primary stage transfer tube, wherein the exhaust gases introduced into the primary chamber by way of the inlet pass through the catalyst prior to entering the primary stage transfer tube.

In another aspect of the exhaust system of the present invention described above, the catalyst is disposed within the primary stage transfer tube, wherein the exhaust gases exiting the primary chamber pass through the catalyst prior to entering the outlet.

In another aspect of the exhaust system of the present invention described above, the exhaust system further includes a canister, wherein at least a portion of the canister forms an outer wall of the primary chamber of each of the at least two exhaust units.

In another aspect of the exhaust system of the present invention described above, at least one of the at least two exhaust units further comprises a secondary chamber located adjacent to the primary chamber, wherein the primary stage transfer tube fluidly connects the primary chamber and the secondary chamber.

In another aspect of the exhaust system of the present invention described above, the primary stage transfer tube of at least one of the plurality of exhaust units directly fluidly connects the primary chamber to the outlet such that the exhaust gases are transferrable directly from the primary chamber to the outlet.

In another aspect of the exhaust system of the present invention described above, the primary stage transfer tube of at least one of the plurality of exhaust units fluidly connects the primary chamber to the outlet such that the exhaust gases are transferrable indirectly from the primary chamber to the outlet such that the exhaust gases change direction of flow as the exhaust gases flow from the primary stage transfer tube to the outlet.

In yet another aspect of the present invention, an exhaust system for exhausting exhaust gases from a small engine having multiple cylinders is provided. The exhaust system includes a plurality of exhaust units. Each of the exhaust units includes a primary chamber, an inlet, a secondary chamber, a primary stage transfer tube, an outlet, and a catalyst. The inlet is fluidly connected to the primary chamber for introducing exhaust gases into the primary chamber. At least a portion of the primary stage transfer tube is located within the primary chamber and at least a portion of the primary stage transfer tube is located within the secondary chamber. The primary stage transfer tube fluidly connects the primary chamber with the secondary chamber. The outlet is fluidly connected to the secondary chamber for exhausting the exhaust gases. The catalyst is located between the inlet and the outlet, wherein the exhaust gases are passable through the catalyst as the exhaust gases flow from the inlet to the outlet.

In another aspect of the exhaust system of the present invention described above, each of the plurality of exhaust units is separable from another of the plurality of exhaust units by a shared chamber wall.

In another aspect of the exhaust system of the present invention described above.

In still another aspect of the present invention, an exhaust system for exhausting exhaust gases from a small engine having multiple cylinders is provided. The exhaust system includes an elongated canister, a first exhaust unit, and a second exhaust unit. The elongated canister is formed of a substantially cylindrical skin, a first end wall and an opposing second end wall enclosing a volume therein. The first exhaust unit includes a first inlet, a first outlet, and a first catalyst, wherein an inner chamber wall is located within the cylindrical skin. The inner chamber wall, the first end wall, and a portion of the skin of the first exhaust unit define a first exhaust volume therein, and the first catalyst is located within the first exhaust volume. The first inlet and the first outlet operatively connected to the skin and fluidly connected to the first exhaust volume such that exhaust gases are introducible into the first exhaust volume through the first inlet. The exhaust gases are passable through the first catalyst when flowing from the first inlet to the first outlet, and the exhaust gases are exhaustible from the first exhaust volume through said the inlet. The second exhaust unit includes a second inlet, a second outlet, and a second catalyst, wherein the inner chamber wall disposed within the cylindrical skin, the second end wall, and a portion of the skin define a second exhaust volume therein. The second exhaust volume is located immediately adjacent to and separate from the first exhaust volume. The second inlet and the second outlet are operatively connected to the skin and fluidly connected to the second exhaust volume such that exhaust gases are introducible into the second exhaust volume through the second inlet and the exhaust gases are exhaustible from the second exhaust volume through the second outlet. The exhaust gases introducible into the first exhaust volume remain separate from exhaust gases introducible into the second exhaust volume by the inner chamber wall.

BRIEF DESCRIPTION OF THE DRAWINGS

The structure, operation, and advantages of the presently disclosed embodiment of the invention will become apparent when consideration of the following description taken in conjunction with the accompanying drawings wherein.

Corresponding reference characters indicate corresponding parts throughout the views of the drawings.

DETAILED DESCRIPTION OF THE INVENTION

Reference will now be made in detail to various and alternative exemplary embodiments and to the accompanying drawings, with like numerals representing substantially identical structural elements. Each example is provided by way of explanation and not as a limitation. In fact, it will be apparent to those skilled in the art that modifications and variations can be made without departing from the scope or spirit of the disclosure and claims. For instance, features illustrated or described as part of one embodiment can be used on another embodiment to yield a still further embodiment. Thus, it is intended that the present disclosure includes modifications and variations as come within the scope of the appended claims and their equivalents.

Figure 1:
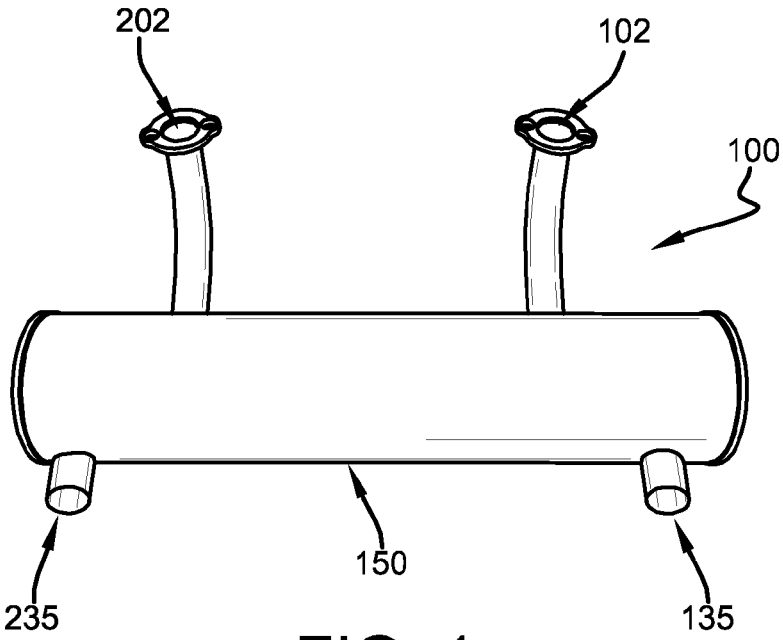
FIG. 1 is a perspective view of one embodiment in accordance with the present invention.

FIG. 1 shows an embodiment of exhaust system 100 having exhaust system inlets 102 and 202, canister 150, and outlets 135 and 235. It is contemplated that inlets 102 and 202 can be headpipes or be in flow communication with headpipes. In the preferred embodiment, inlets 102 and 202 are headpipes of essentially the same length and diameter. It is contemplated that outlets 135 and 235 can be tailpipes or be in flow communication with tailpipes. In the preferred embodiment, outlets 135 and 235 are tailpipes.

Figure 2:
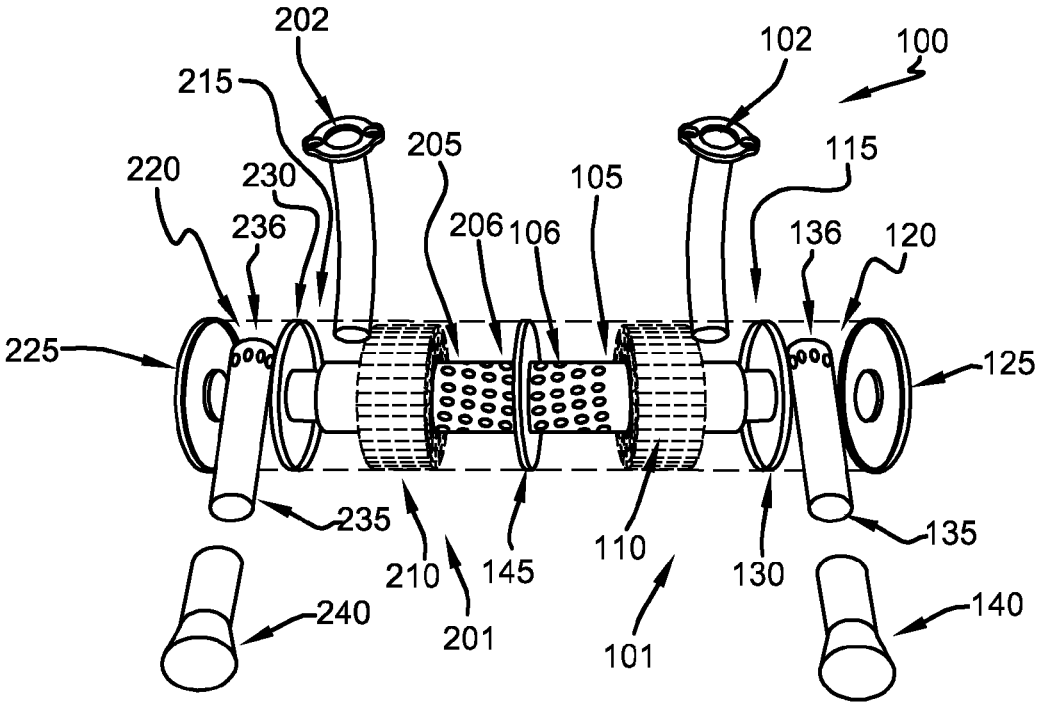
FIG. 2 is a perspective view of FIG. 1 with the skin of the canister removed.

FIG. 2 shows exhaust system 100 with the skin of canister 150 removed. In this embodiment, exhaust system 100 has two exhaust units 101 and 201. Exhaust units 101 and 201 include the volume within the skin of the canister (FIG. 1) and are separated by inner chamber wall 145, which prevents the mixing of exhaust gasses from exhaust units 101 and 201. It is contemplated that other embodiments of exhaust system 100 may have two or more exhaust units to correspond to the same number of cylinders as the engine to which it is attached.

Exhaust unit 101 includes an inlet 102, outlet 135, primary chamber 115, and secondary chamber 120. Inlet 102 is in fluid communication with the primary chamber 115 of exhaust unit 101 for introducing exhaust gases from the engine into the primary chamber 115. Primary chamber 115 contains catalyst 110 and at least a portion of a primary stage transfer tube 105 therein. The primary stage transfer tube 105 extends between the primary chamber 115 and the secondary chamber 120 and fluidly connects these chambers. Exhaust gasses are exhaustible from the secondary chamber 120 into the atmosphere through outlet 135. It is contemplated that primary chamber 115 and secondary chamber 120 can be various sizes and can be equipped with various configurations of baffles that reflect and absorb selected sound power while maintaining separation of exhaust gasses.

In operation, exhaust gasses are introduced from a first internal combustion engine cylinder (not shown) into the primary chamber 115 of exhaust unit 101 through the inlet 102. Primary chamber 115 is defined by the first chamber wall 130, inner chamber wall 145, and a portion of the skin of canister 150. The exhaust gasses then exit the inlet 102, pass through the catalyst 110, and then enter a first end of the primary stage transfer tube 105. In the preferred embodiment, exhaust gasses enter primary stage transfer tube 105 through helical perforations 106 which cause the direction of flow of the exhaust gasses to turn. Primary stage transfer tube 105 extends between the primary chamber 115 and the secondary chamber 120 to fluidly connect these chambers and allow exhaust gasses to flow through the first chamber wall 130 that separates the primary and secondary chambers 115, 120. In the preferred embodiment, catalyst 110 is located as close as practical to inlet 102, and more particularly, the catalyst 110 is located between the skin of canister 150 and the outside of primary transfer tube 105. In an alternative embodiment depicted in FIG. 3, catalyst 110 is located within a portion of the primary stage transfer tube 105 disposed within the primary chamber 115, and exhaust gasses pass through catalyst 110 while flowing through primary stage transfer tube 105 en route to secondary chamber 120. Secondary chamber 120 is defined by the first chamber wall 130, a portion of the skin of canister 150, and a first end wall 125. The exhaust gasses exit secondary chamber 120 through the outlet 135.

Exhaust unit 201 includes an inlet 202, outlet 235, primary chamber 215, and secondary chamber 220. Inlet 202 is in fluid communication with the primary chamber 215 of exhaust unit 201 for introducing exhaust gases from the engine into the primary chamber 215. Primary chamber 215 contains catalyst 210 and at least a portion of a primary stage transfer tube 205 therein. The primary stage transfer tube 205 extends between the primary chamber 215 and the secondary chamber 220 and fluidly connects these chambers. Exhaust gasses are exhaustible from the secondary chamber 220 into the atmosphere through outlet 235. It is contemplated that primary chamber 215 and secondary chamber 220 can be various sizes and can be equipped with various configurations of baffles that reflect and absorb selected sound power while maintaining separation of exhaust gasses.

In operation, exhaust gasses are introduced from a first internal combustion engine cylinder (not shown) to the primary chamber 215 of exhaust unit 201 through the inlet 202. Primary chamber 215 is defined by a first chamber wall 230, inner chamber wall 145, and a portion of the skin of canister 150. The exhaust gasses then exit the inlet 202, pass through the catalyst 210 and then enter a first end of the primary stage transfer tube 205. In the preferred embodiment, exhaust gasses enter primary stage transfer tube 205 through helical perforations 206 which cause the direction of flow of the exhaust gasses to turn. Primary stage transfer tube 205 extends between the primary chamber 215 and the secondary chamber 220 to fluidly connect these chambers and allow exhaust gasses to flow through the first chamber wall 230 that separates the primary and secondary chambers 215, 220. In the preferred embodiment, catalyst 210 is located as close as practical to inlet 202, and more particularly, the catalyst 210 is located between the skin of canister 150 and the outside of primary transfer tube 205. In an alternative embodiment depicted in FIG. 3, catalyst 210 is located within a portion of the primary stage transfer tube 205 disposed within the primary chamber 215, and exhaust gasses pass through catalyst 210 while flowing through primary stage transfer tube 205 en route to secondary chamber 220. Secondary chamber 220 is defined by the first chamber wall 230, a portion of the skin of canister 250, and a second end wall 225. The exhaust gasses exit secondary chamber 220 through outlet 235.

In some embodiments, tail pipes 135 and 235 are equipped with permanent or removable spark arrestors 140 and 240, which can reduce the emission of carbon particles and flames from outlets 135 and 235. In the preferred embodiment, exhaust gasses enter the outlets 135 and 235 through helical perforations 136 and 236 which cause the direction of flow of the exhaust gasses to turn. Additionally, in some embodiments, outlets 135 and 235 are fixed in place, while in other embodiments, outlets 135 and 235 are removable, which simplifies periodic cleaning.

As can be seen, it is contemplated that catalysts 110 and 210 can be a variety of shapes and may be placed in various locations between inlets 102 and 202 and outlets 135 and 235. Further, it is contemplated that some embodiments of exhaust system 100 may not use catalysts.

Because exhaust units 101 and 201 are not in fluid communication with each other within the canister, exhaust gasses within exhaust units 101 and 201 do not mix within the volume defined by the canister. This separation of exhaust gasses prevents the creation of a thermal run-away during an off nominal condition in which exhaust gasses from different cylinders mix and ignite, potentially reaching a temperature of over 2300° F.

Figure 3:
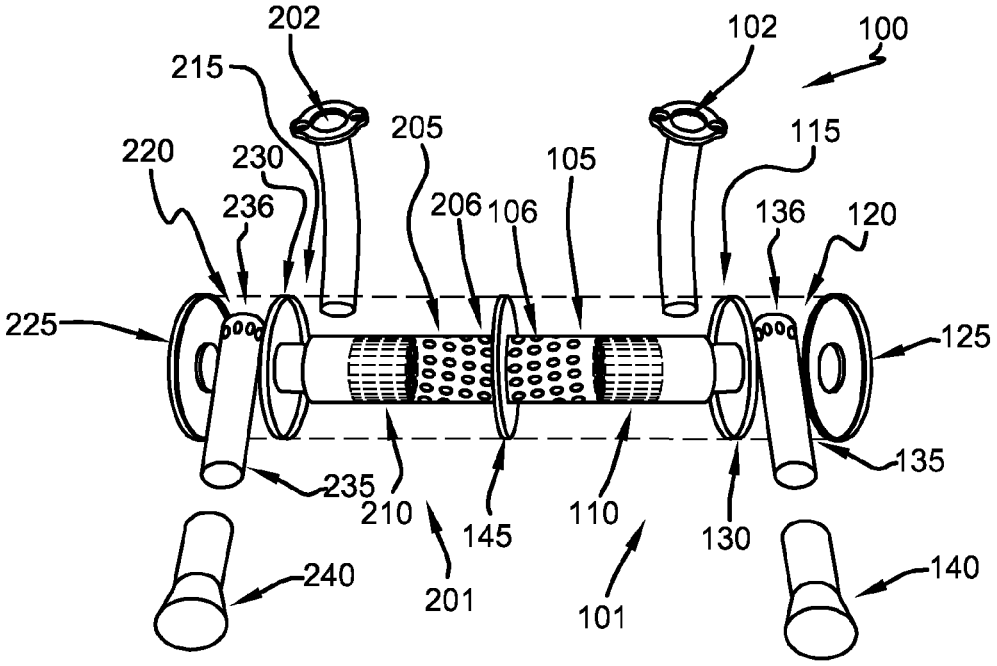
FIG. 3 is a perspective view of a second embodiment in accordance with the present invention with the skin of the canister removed.
Figure 4:
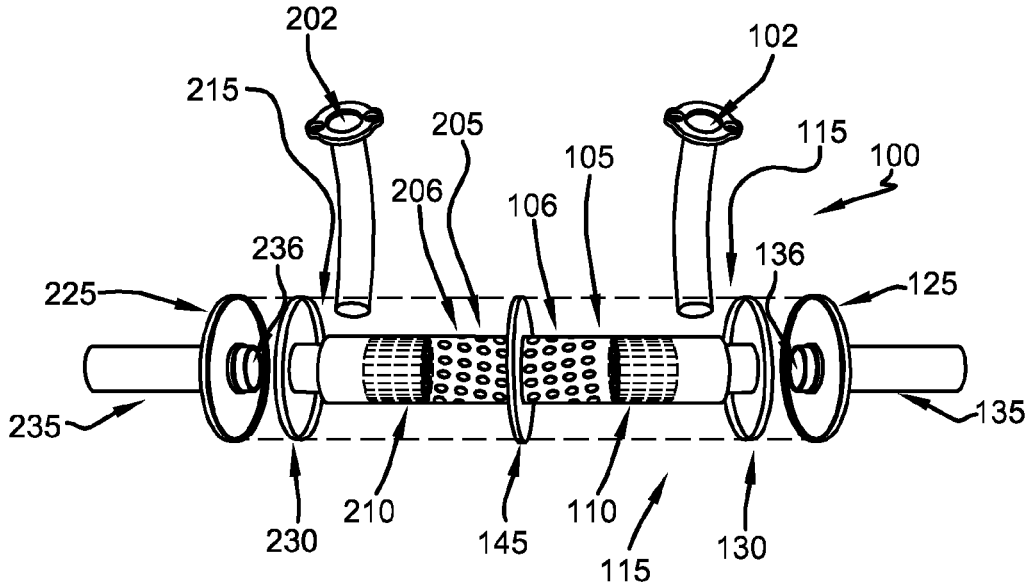
FIG. 4 is a perspective view of a third embodiment in accordance with the present invention with the skin of the canister removed.

Under certain circumstances, unignited exhaust gasses can ignite when passing through catalysts 110 and 210. In some embodiments, outlets 135 and 235 are aligned with primary stage transfer tubes 105 and 205, as is shown in FIG. 4, which does little to hinder any flames passing through primary stage transfer tubes 105 and 205 from exiting outlets 135 and 235. However, as depicted in FIGS. 3 and 4 outlets 135 and 235 in other embodiments are oriented at an angle relative to the primary stage transfer tubes 105 and 205, which forces any resulting flames exiting primary stage transfer tube 105 and 205 to change direction prior to exiting outlet 135 and 235. Further, helical perforations 136 and 236 in outlets 135 and 235 require the flames to turn an additional 180 degrees in order to enter outlets 135 and 235. These additional turns and length that the exhaust must travel serves to quench the flames and stop the reaction in the catalysts.

Further, tests have shown that exhaust gasses emitted from embodiments of exhaust system 100 containing non-optimized catalysts have $HC+NO_X$ readings of 4.90, which approach the Blue Sky emissions level of 4.0. Accordingly, since exhaust system 100 reduces the dangers of off nominal conditions, the catalyst efficiency can be increased and optimized to achieve a Blue Sky $HC+NO_X$ emissions level.

Figure 5:
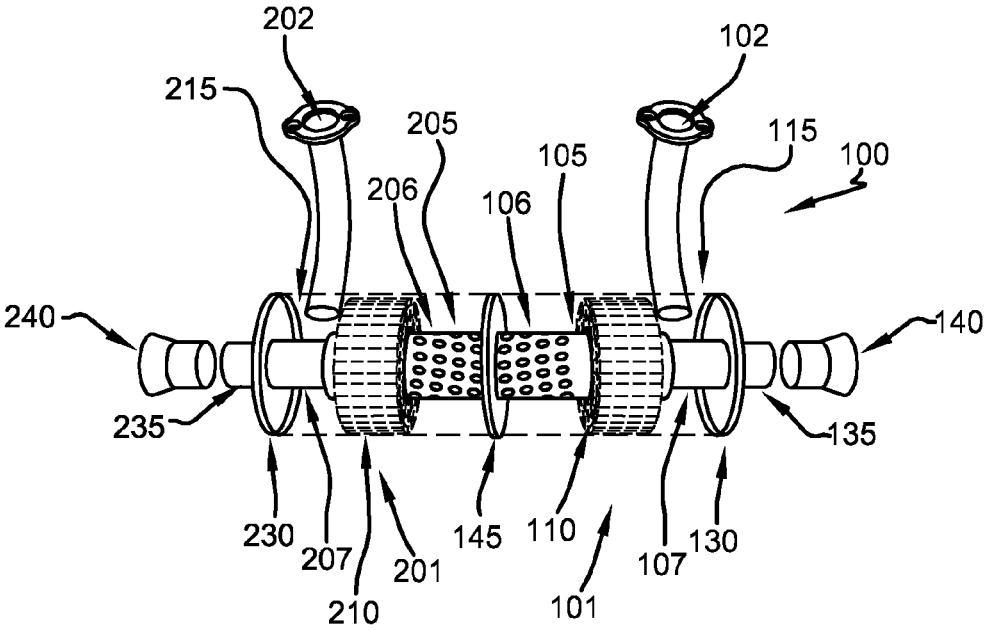
FIG. 5 is a perspective view of a fourth embodiment in accordance with the present invention with the skin of the canister removed.

FIG. 5 shows another embodiment of exhaust system 100 with the skin of canister 150 removed. In this embodiment, exhaust system 100 has two exhaust units 101 and 201. Exhaust units 101 and 201 are separated by inner chamber wall 145, which prevents the mixing of exhaust gasses from exhaust units 101 and 201.

Exhaust unit 101 includes an inlet 102, an outlet 135, and primary chamber 115. Inlet 102 is in fluid communication with the primary chamber 115 of exhaust unit 101 for introducing exhaust gases from one cylinder of the engine (not shown) into the primary chamber 115. Primary chamber 115 contains catalyst 110 and at least a portion of the primary stage transfer tube 105 therein. Outlet 135 vents exhaust gasses into the environment and can be an extension of primary stage transfer tube 105. It is contemplated that outlet 135 can be removable or fixed to canister 150. It is contemplated that primary chamber 115 can be various sizes and can be equipped with various configurations of baffles that reflect and absorb selected sound power while maintaining separation of exhaust gasses.

In operation, exhaust gasses are introduced from a first internal combustion engine cylinder (not shown) into the primary chamber 115 of exhaust unit 101 through inlet 102. Primary chamber 115 is defined by the first chamber wall 130, inner chamber wall 145, and a portion of the skin of canister 150. The exhaust gasses then exit the inlet 102, pass through catalyst 110, and then enter a first end of the primary stage transfer tube 105. In the preferred embodiment, exhaust gasses enter primary stage transfer tube 105 through helical perforations 106 which cause the direction of flow of the exhaust gasses to turn. Primary stage transfer tube 105 extends between the primary chamber 115 and the outlet 135 and fluidly connects the primary chamber 115 with the outlet 135 to allow exhaust gasses to flow through the first chamber wall 130 and into outlet 135 through which exhaust gasses into the environment. In the preferred embodiment, catalyst 110 is situated as close as practical to inlet 102 and located between the skin of canister 150 and the outside of primary stage transfer tube 105.

Exhaust unit 201 includes an inlet 202, outlet 235, and primary chamber 215. Inlet 202 is in fluid communication with the primary chamber 215 of exhaust unit 201 for introducing exhaust gases from the engine into the primary chamber 215. Primary chamber 215 contains catalyst 210 and at least a portion of the primary stage transfer tube 205 therein. Outlet 235 vents exhaust gasses into the environment and can be an extension of primary stage transfer tube 205. It is contemplated that outlet 235 can be removable or fixed to canister 150. It is contemplated that primary chamber 215 can be various sizes and can be equipped with various configurations of baffles that reflect and absorb selected sound power while maintaining separation of exhaust gasses.

In operation, exhaust gasses are introduced from a first internal combustion engine cylinder (not shown) into the primary chamber 215 of exhaust unit 201 through inlet 202. Primary chamber 215 is defined by the first chamber wall 230, inner chamber wall 145, and a portion of the skin of canister 150. The exhaust gasses then exit the inlet 102, pass through the catalyst 210, and then enter a first end of the primary stage transfer tube 205. In the preferred embodiment, exhaust gasses enter primary stage transfer tube 205 through helical perforations 206 which cause the direction of flow of the exhaust gasses to turn. Primary stage transfer tube 205 extends between the primary chamber 115 and the outlet 235 to fluidly connect these members and allow exhaust gasses to flow through the first chamber wall 230 and into outlet 235 through which exhaust gasses enter the environment. In the preferred embodiment, catalyst 210 is located as close as practical to inlet 202, and more particularly, the catalyst 210 is located between the skin of canister 250 and the outer surface of primary stage transfer tube 205.

Further, as depicted in FIGS. 2-5, it is contemplated that canister 150 contains the primary chambers, and secondary chambers if present, of each exhaust unit that comprise exhaust system 100. It is further contemplated that the first and second exhaust units 101, 201 are located immediately adjacent to each other, and if the exhaust system includes more than two exhaust units, each of the exhaust units is located immediately adjacent to at least one other exhaust unit and separated therefrom by an inner chamber wall 145.

Figure 6:
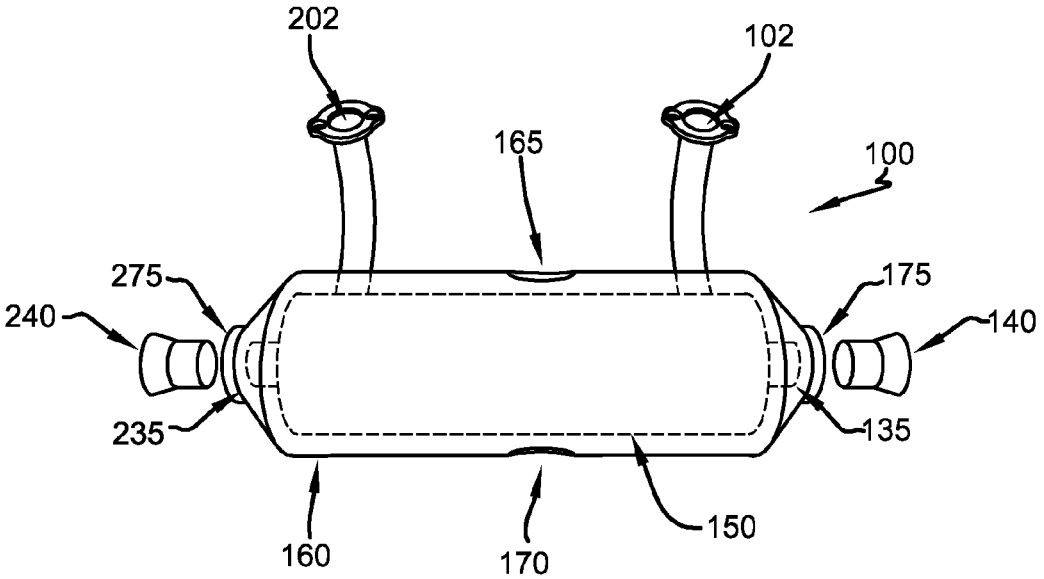
FIG. 6 is a perspective view of a fifth embodiment in accordance with the present invention.

In FIG. 6 it is contemplated that some embodiments of exhaust system 100 include shroud 160 which covers and surrounds exhaust system inlets 102 and 202, canister 150, and at least a portion of outlets 135 and 235. Shroud 160 has air intakes 165 and 170 and air egresses 175 and 275, which promote air circulation under shroud 160, thereby reducing the temperature of exhaust system 100 and exhaust gasses and providing for flame quenching during off-nominal conditions. This system also provides for exhaust dilution to further reduce the average temperature of the exhaust.

While this invention has been described in conjunction with the specific embodiments described above, it is evident that many alternatives, combinations, modifications and variations are apparent to those skilled in the art. Accordingly, the preferred embodiments of this invention, as set forth above are intended to be illustrative only, and not in a limiting sense. Various changes can be made without departing from the spirit and scope of this invention.

The invention claimed is:

1. An exhaust system for exhausting exhaust gases from a small engine having multiple cylinders, said exhaust system comprising:

at least two exhaust units, wherein each of said exhaust units comprises:

a primary chamber;

a headpipe directly and fluidly connected to said primary chamber for introducing exhaust gases into said primary chamber;

an outlet fluidly connected to said primary chamber for exhausting exhaust gases from said primary chamber;

a primary stage transfer tube, wherein at least a portion of said primary stage transfer tube is located within said primary chamber, said primary stage transfer tube fluidly connecting said primary chamber with said outlet;

a catalyst located within the primary chamber between said headpipe and said outlet through which said exhaust gases pass as said exhaust gases flow from said headpipe to said outlet; and a canister, wherein at least a portion of said canister forms an outer wall of said primary chamber of each of said at least two exhaust units;

wherein each of said at least two exhaust units is separated from at least one other of said at least two exhaust units by a common chamber wall, wherein said chamber wall maintains separation between exhaust gases flowing through each of said at least two exhaust units.

2. The exhaust system of claim 1, wherein at least two of said at least two exhaust units are disposed immediately adjacent to each other.

3. The exhaust system of claim 1, wherein said catalyst is disposed about a portion of said primary stage transfer tube, wherein said exhaust gases introduced into said primary chamber by way of said headpipe pass through said catalyst prior to entering said primary stage transfer tube.

4. The exhaust system of claim 1, wherein said catalyst is disposed within said primary stage transfer tube, wherein said exhaust gases exiting said primary chamber pass through said catalyst prior to entering said outlet.

5. The exhaust system of claim 1, wherein at least one of said at least two exhaust units further comprises a secondary chamber located adjacent to said primary chamber, wherein said primary stage transfer tube fluidly connects said primary chamber and said secondary chamber.

6. The exhaust system of claim 1, wherein said primary stage transfer tube of at least one of said plurality of exhaust units fluidly connects said primary chamber to said outlet such that said exhaust gases are transferrable indirectly from said primary chamber to said outlet such that said exhaust gases change direction of flow as said exhaust gases flow from said primary stage transfer tube to said outlet.

7. An exhaust system for exhausting exhaust gases from a small engine having multiple cylinders, said exhaust system comprising:

a plurality of exhaust units, wherein each of said exhaust units comprises:

a primary chamber;

a headpipe directly and fluidly connected to said primary chamber for introducing exhaust gases into said primary chamber;

a secondary chamber;

a primary stage transfer tube, wherein at least a portion of said primary stage transfer tube is located within said primary chamber and at least a portion of said primary stage transfer tube is located within said secondary chamber, said primary stage transfer tube fluidly connecting said primary chamber with said secondary chamber;

an outlet fluidly connected to said secondary chamber for exhausting said exhaust gases;

a catalyst located between said headpipe and said outlet, wherein said exhaust gases are passable through said catalyst as said exhaust gases flow from said headpipe to said outlet; and a canister, wherein at least a portion of said canister forms an outer wall of said primary chamber of each of said plurality of exhaust units.

8. The exhaust system of claim 7, wherein each of said plurality of exhaust units is separable from another of said plurality of exhaust units by a shared chamber wall.

* * * * *